US007051950B2

(12) United States Patent
Giuliano

(10) Patent No.: US 7,051,950 B2
(45) Date of Patent: May 30, 2006

(54) ATOMIZER FOR COATING UNIT AND METHOD FOR ITS MATERIAL SUPPLY

(75) Inventor: Stefano Giuliano, Leonberg (DE)

(73) Assignee: Dürr Systems, Inc., Plymouth, MI (US)

( * ) Notice: Subject to any disclaimer, the term of this patent is extended or adjusted under 35 U.S.C. 154(b) by 0 days.

(21) Appl. No.: 11/158,130

(22) Filed: Jun. 21, 2005

(65) Prior Publication Data

US 2005/0230503 A1 Oct. 20, 2005

Related U.S. Application Data

(63) Continuation of application No. 10/360,782, filed on Mar. 26, 2002.

(30) Foreign Application Priority Data

Mar. 29, 2001 (DE) ..... 101 15 463

(51) Int. Cl.
*B05B 15/02* (2006.01)

(52) U.S. Cl. ..... 239/123; 239/112; 239/104; 239/693; 15/3.5; 15/3.51

(58) Field of Classification Search ..... 239/706, 239/693, 104, 123, 112; 118/300, 621; 427/235, 427/239, 238, 230, 421; 15/3.5, 3.51
See application file for complete search history.

(56) References Cited

U.S. PATENT DOCUMENTS 4,020,866 A * 5/1977 Wiggins ..... 137/592
4,137,623 A * 2/1979 Taylor ..... 29/433
4,376,135 A 3/1983 Patel et al.
4,521,462 A 6/1985 Smythe
4,572,437 A 2/1986 Huber et al.
4,589,597 A 5/1986 Robisch et al.
4,684,064 A 8/1987 Kwok
4,715,314 A 12/1987 Ramseier et al.
4,852,810 A 8/1989 Behr et al.
4,919,333 A 4/1990 Weinstein
4,921,169 A 5/1990 Tilly
4,927,081 A 5/1990 Kwok et al.
4,944,459 A 7/1990 Watanabe et al.
4,955,960 A 9/1990 Behr et al.
5,011,086 A 4/1991 Sonnleitner et al.
5,078,321 A 1/1992 Davis et al.
5,127,125 A 7/1992 Skibowski
5,221,047 A 6/1993 Akeel
5,294,217 A 3/1994 Talacko et al.
5,300,006 A 4/1994 Tanaka et al.
5,397,063 A 3/1995 Weinstein
5,622,563 A 4/1997 Howe et al.
5,630,552 A 5/1997 Anfindsen et al.

(Continued)

FOREIGN PATENT DOCUMENTS

DE 34 29 075 A1 2/1986

(Continued)

*Primary Examiner*—Dinh Q. Nguyen
(74) *Attorney, Agent, or Firm*—Howard & Howard

(57) ABSTRACT

The atomizer (Z) of an electrostatic coating unit contains a dosing pump (DP) connected between the atomization device (4) and a scrapeable coiled pipe (10) which serves as a space-saving paint supply vessel and which is also situated in the atomizer. The scraper (12) is activated by compressed air on one side in order to force the paint material fed to its other side to the dosing pump (DP), which conveys it to the atomization device (4).

17 Claims, 3 Drawing Sheets

U.S. PATENT DOCUMENTS

| | | | |
|---|---|---|---|
| 5,633,306 | A | 5/1997 | Howe et al. |
| 5,662,278 | A | 9/1997 | Howe et al. |
| 5,683,032 | A | 11/1997 | Braslaw et al. |
| 5,704,977 | A | 1/1998 | Baumann et al. |
| 5,865,380 | A | 2/1999 | Kazama et al. |
| 6,037,010 | A | 3/2000 | Kahmann et al. |
| 6,090,450 | A | 7/2000 | Kahmann et al. |
| 6,508,610 | B1 | 1/2003 | Dietrich |
| 6,589,348 | B1 | 7/2003 | Ott |

FOREIGN PATENT DOCUMENTS

| | | | |
|---|---|---|---|
| DE | 41 05 116 | A1 | 8/1992 |
| DE | 43 06 800 | A1 | 9/1994 |
| DE | 43 42 128 | A1 | 6/1995 |
| DE | 196 10 588 | A1 | 9/1997 |
| DE | 197 09 988 | A1 | 10/1998 |
| DE | 197 42 588 | A1 | 4/1999 |
| DE | 198 30 029 | A1 | 1/2000 |
| DE | 199 09 369 | A1 | 9/2000 |
| DE | 199 37 425 | A1 | 3/2001 |
| DE | 100 33 986 | A1 | 1/2002 |
| DE | 100 63 234 | C1 | 7/2002 |
| DE | 101 15 470 | A1 | 10/2002 |
| DE | 101 30 173 | A1 | 1/2003 |
| DE | 102 02 712 | A1 | 7/2003 |
| EP | 0 171 042 | B1 | 7/1988 |
| EP | 0 767 005 | A1 | 4/1997 |
| EP | 0 801 991 | A3 | 4/1997 |
| EP | 0 796 663 | B1 | 9/1997 |
| EP | 0 904 848 | A1 | 3/1999 |
| EP | 0 967 016 | A1 | 12/1999 |
| EP | 1 108 475 | A2 | 6/2001 |
| EP | 1 114 677 | A1 | 7/2001 |
| EP | 1 118 388 | A1 | 7/2001 |
| EP | 1 172 152 | A1 | 1/2002 |
| WO | WO 94/22589 | | 10/1994 |

* cited by examiner

ATOMIZER FOR COATING UNIT AND METHOD FOR ITS MATERIAL SUPPLY

RELATED APPLICATIONS

This application is a continuation of and claims priority to U.S. patent application Ser. No. 10/360,782 and filed Mar. 16, 2002 and German Application No. 101 15 463.1 filed Mar. 29, 2001.

The invention concerns an atomizer and a method for material supply of an atomizer for a coating machine according to the preamble of the independent claims. The atomizer, in particular, is an electrostatic rotary or air atomizer mounted as a complete unit replaceably on a painting robot or other coating machine for the sequential coating of workpieces, such as vehicle bodies.

Such atomizers permit, among other things, advantageous paint change concepts and simple potential separation between electrostatic atomization devices operating with direct charging of the coating material and the paint supply system grounded for safety reasons, since the supply vessels are separated during coating from the grounded supply system and can be simply and automatically replaced for a paint change without or even with the actual atomizer. Known atomizers of this type contain dosing cylinders operated mechanically by a spindle drive (DE 196 10 588 A). Such dosing cylinders, however, have large space requirements stemming from their design. Their length, which is about twice as great as the piston stroke because of the piston rod, has an adverse effect mostly on painting robots or other handling machines on the accessibility of workpiece regions, such as vehicle interiors. Atomizers with hydraulically driven dosing cylinders are also already known (EP 0 967 016 A), whose compressed fluid, however, must be fed by a dosing pump located outside the atomizer.

Moreover, general problems develop in dosing cylinders, like high requirements on support and bearing to guarantee the desired dosing accuracy and dynamics, which not only increase the design expense, but also the weight of the atomizer to be supported by the wrist joint of a robot.

SUMMARY OF THE INVENTION

The objective of the invention is to provide a simply designed, reliable and not too heavy atomizer, whose feeding means suffices without hydraulic dosing and can be accommodated in a limited space, as well as a corresponding method for material supply of the atomizer.

This object is realized by the features of the patent claims.

The invention is suitable especially, but not exclusively, for electrostatic atomizers that are mounted as a whole replaceably on painting robots or other coating machines and permit in simple fashion both the required potential separation from the grounded supply system of the coating unit and rapid and problem-free paint changes without significant losses of paint and rinsing agents with an arbitrary number of selectable paints. For example, in the case of painting robots, it is also advantageous that costly hose lines can be dispensed with within the machine, since the internal feeding means of the atomizer can be filled with the atomizer disassembled.

The preferred design of a dosing pump designed as a geared pump in the atomizer has the advantage that a dosing cylinder of known type is unnecessary in this conventional, reliable component that has long proven itself.

The structure of the paint supply vessel as a wound tube has the advantage that, on the one hand, because of the significant reduction in diameter in comparison with ordinary cylindrical paint vessels, correspondingly lower paint change losses and losses of rinsing agent occur and, on the other hand, the design flexibility is improved especially with respect to space savings. The same applies to the likewise possible use of one or more rigid coiled pipes as paint supply vessel(s).

Since the wound tube or coiled pipe is preferably scraped in order to convey the coating material to the atomization device via the dosing pump and to force any residual paint back in the direction toward the grounded supply system of the coating installation, a very simple possibility is obtained at the same time for cleaning of the tube interior of the feeding means by the scraper in known fashion.

BRIEF DESCRIPTION OF THE DRAWINGS

The invention is further explained in the practical example shown in the drawing. In the drawing.

DETAILED DESCRIPTION OF THE PREFERRED EMBODIMENT

Figure 1:
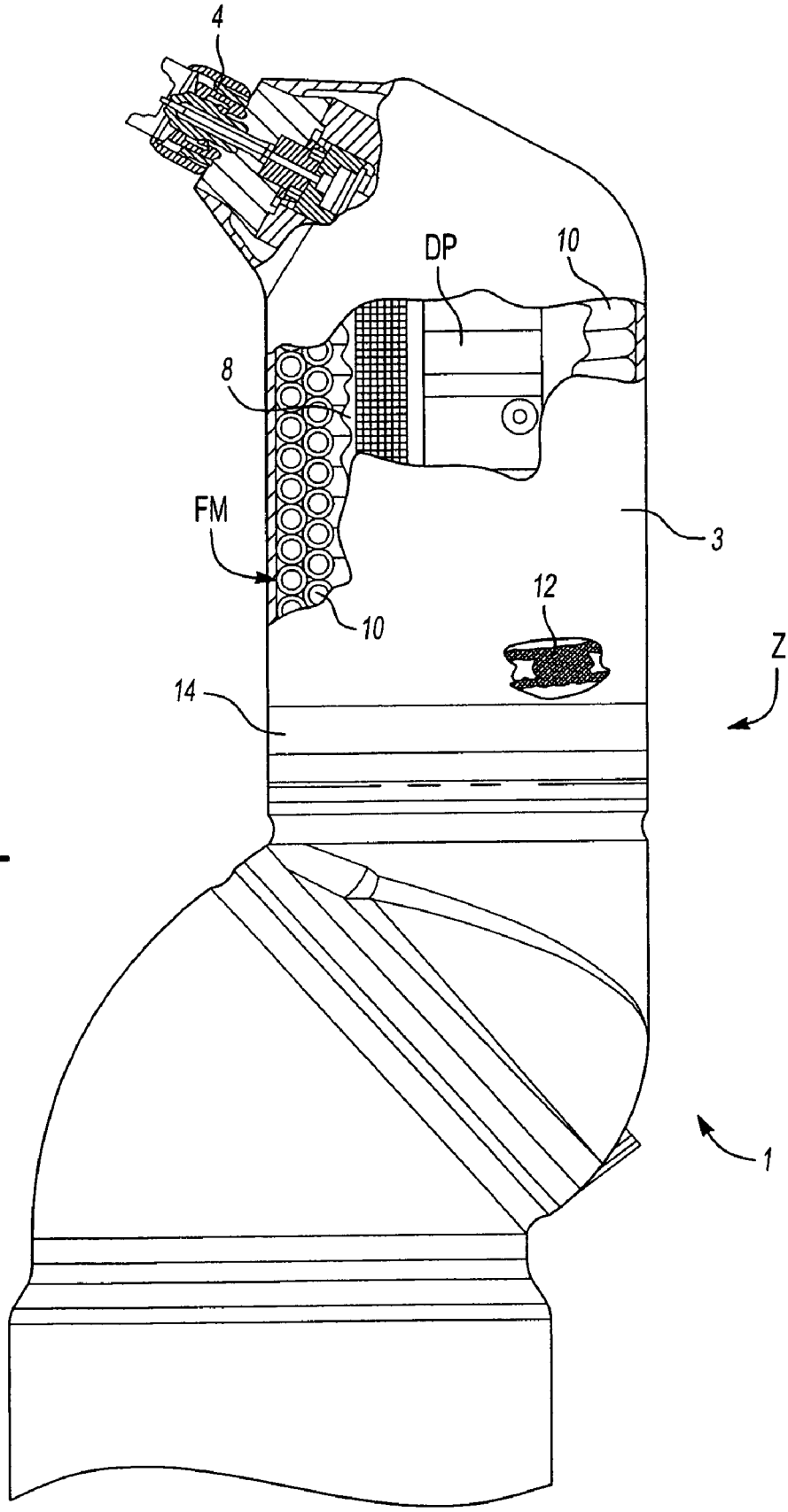
FIG. 1 shows an air atomizer mounted on the wrist joint of a painting robot.

According to FIG. 1, an atomizer Z is mounted on wrist joint 1 of a robot, in whose housing 3 an air atomization device arranged in the front region, whose design and method of function are known and therefore require no explanation. The essentially cylindrical main part of housing 3 contains a dosing pump DP arranged coaxially in the middle of the housing, for example, a geared pump with an also known method of operation. The dosing pump DP is connected to atomization device 4 via valve unit 22 (FIG. 2) and can be controlled to convey in two opposite directions. The drive (not shown) of the dosing pump DP is expediently designed mechanically, for example, with a flexible shaft, which can be driven in turn via bevel gears and a pinion drive on the robot axis (by doubling of the robot axis usually referred to as axis 6). Another possibility is direct drive of the dosing pump DP by an electric motor situated in the atomizer.

A paint wound tube 10 of the shown two-layer coil form is arranged in the essentially annular space 8 in the cylindrical part of housing 3 surrounding the dosing pump DP, which serves as supply vessel for the coating material. One tube end is connected to the side of the dosing pump DP facing away from the atomization device 4, whereas the other tube end is connected to an external compressed air connection (V3A in FIG. 2).

A special feature of wound tube 10 serving as a supply vessel is scrapeability. Scraper 12 situated in paint tube FM of wound tube 10 can be pushed by compressed air from the mentioned compressed air connection through the entire wound tube in order to force the coating material situated in it to dosing pump DP. Appropriate scrapers for this purpose are known.

It is assumed in the following explanation of the method of operation that atomizer Z on flange 14 is mounted releaseably on robot wrist joint 1 and is removed for filling of wound tube 10 with coating material and connected to the filling station 20 shown in FIG. 2, serving also as an atomizer change and rinsing station.

Figure 2:
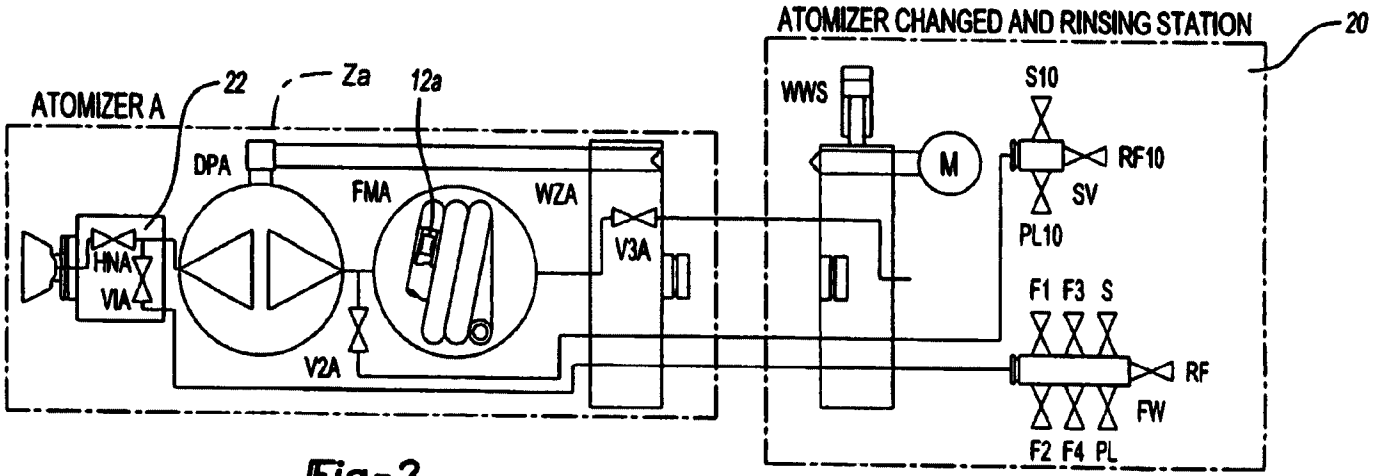
FIGS. 2 and 3 schematically show the paint supply concept for an atomizer of the type described here.

The atomizer designated ZA in FIG. 2 contains valve unit 22 with the usual main needle valve HNA for the atomization device fed by pump DPA and a branching paint supply valve V1A, connected between the dosing pump DPA and the atomization device, shown here as a rotary bell. A rinsing and return line branches off via a valve V2A from the line connecting the dosing pump DPA to its opposite side with the paint tube FMA. Paint tube FMA is connected to a compressed air line with compressed air valve V3A on the end facing away from pump DPA.

The filling station 20 contains change system WWS that can be connected to change system WZA on the atomizer side, which includes a drive motor M that is mechanically connectable to dosing pump DPA. The station 20 also contains a rinsing valve arrangement SV connected to valve V2A when the atomizer is connected, with a rinsing valve S10, a pulse air valve PL10 and a return valve RF10, as well a paint changer FW connected to valve V1A with paint valves F1–F4, rinsing and pulse air valves S and PL and a return valve RF. The chosen coating material is forced from the paint changer FW through valve V1A and dosing pump DPA into the end of scrapeable paint tube FMA facing it, in order to fill it, in which scraper 12A is pushed in the direction toward the opposite tube end.

Figure 3:
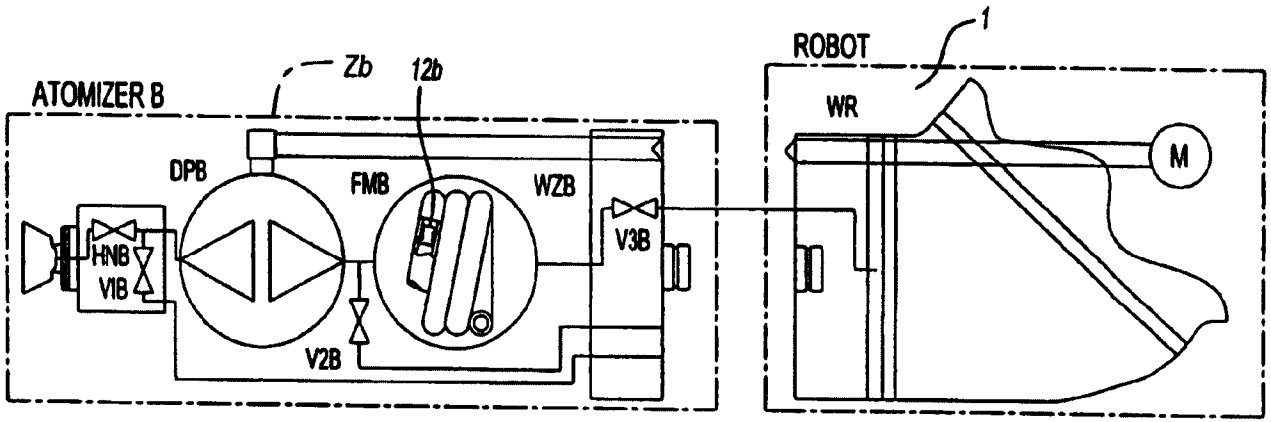

While the atomizer ZA is filled, coating can be carried out with another atomizer ZB connected to the robot hand axis 1 (FIG. 1), as shown in FIG. 3, where the elements corresponding to FIG. 2 are designated with B instead of A. The change system WZB on the atomizer side is coupled to the change system WR on the robot side. The scrapeable paint tube FMB is acted upon with compressed air via valve V3B so that the coating material fed into the tube is forced by scraper 12B to dosing pump DPB and from it conveyed to the atomization device.

The following cycle therefore occurs during an atomizer change with paint change.

Painting with atomizer ZB and first paint: the atomizer ZB is situated on the robot. The two halves of the change system WZB and WR are also coupled to the drive for the dosing pump DPB. The valves V1B and V2B are closed. Valve V3B releases compressed air so that scraper 12B is driven.

The scraper forces the first paint to dosing pump DPB during its movement in paint tube FMB between valves V3B and V2B and the pump doses the paint with the set painting speed, during which it is driven by motor M in the robot. The scraper separates the paint from the compressed air serving as scraper driving medium and simultaneously ensures the cleaning of the paint tube walls. When the main needle valve HNB is opened, the paint flows to the atomization device. The atomizer ZB operates under high voltage.

Start of a paint change program in the atomizer change, rinsing and filling station 20: with an impending paint change, an automatic rinsing and pressure program is started by the installation control. During spraying of the first paint through atomizer ZB, the other atomizer ZA, which is situated in the atomizer change and rinsing station 20, is prepared for the next painting task. The two halves of the change system WZA and WWS are connected here. All valves of station 20 are in their base position.

Rinsing of the atomizer ZA: in the subsequent rinsing process, the scraper 12A is situated in the paint tube FMA directly in front of valve V2A, since it is assumed that it has forced all the paint located in the paint tube during the last painting process (possibly with the exception of a safety volume). Valve V3A is opened so that the scraper is exposed to compressed air. Valve V2A now opens so that by altering opening of valves S10 and PL10 on control valve SV, the rinsing agent-air mixture flows through the dosing pump DPA running at the rinsing speed and through the opened valve HNA. Thus, the atomizer ZA is rinsed from valve V2A via dosing pump DPA. (During rinsing, the pressure of the compressed air acting upon the scraper via valve V3A is greater than the pressure of the rinsing agent-air mixture.) The dosing pump DPA is driven by motor M in station 20 with valve HNA closed the paint changer FW is then briefly rinsed via valve V1A with valve RF open. Upon conclusion of the rinsing process, the entire system can be blown dry with a brief pulsed air interval.

Forcing of the second paint into atomizer ZA: The scraper 12A is situated near valve V2A when valve V3A is opened. After the rinsing process is complete, valves F2, V1A, V2A and RF10 are opened so that the second paint enters the paint channel. The dosing pump DPA runs backwards with the pressure speed. After a time stipulated by the control program according to the feed volume of the dosing pump, valve V2A is closed so that rinsing medium remaining in the paint tube is displaced and the system vented. After valve V2A is closed, the scraper is pushed by the paint column against the pressure of the compressed air to its other end position in the vicinity of valve V3A. After reaching the desired amount of paint by means of the dosing pump, the pressure process is ended. All mentioned valves go back to their base position. Atomizer ZA is now prepared for the next painting process and remains in station 20 until the next atomizer change.

Start of the atomizer change program and changing from atomizer ZB to atomizer ZA: after termination of the painting process with atomizer ZB, the dosing pump DPB is stopped, valve HNB is closed and the high voltage is then reduced. Atomizer ZB can now be replaced with atomizer ZA and a next workpiece painted with the second paint.

Figure 4:
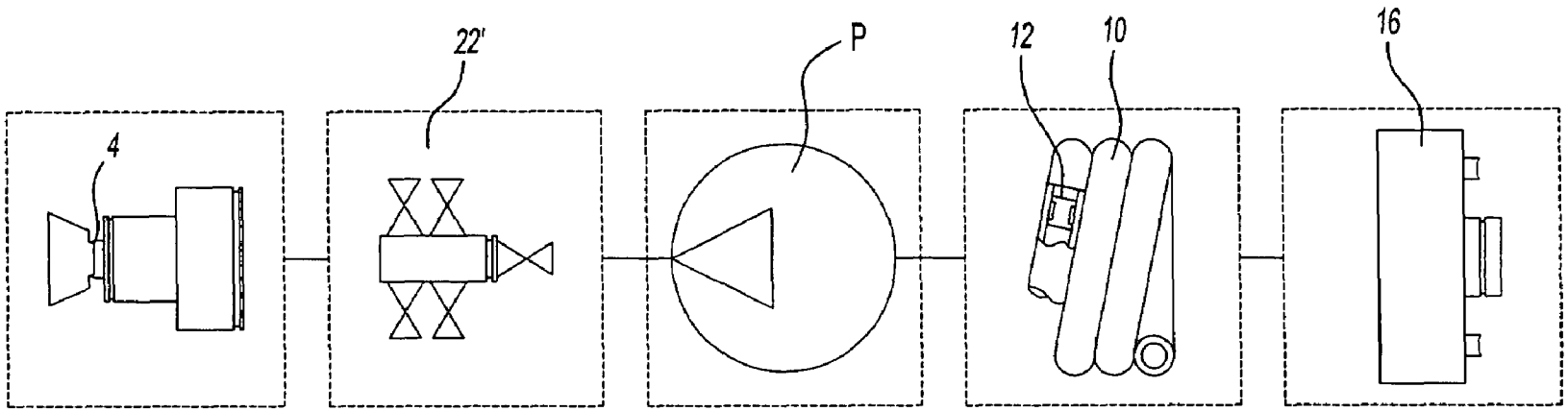
FIG. 4 shows a general view of the atomizer.

The described method of operation is only an example. The general atomizer system according to the invention shown in FIG. 4 with the connection flange 16, the scrapeable line coil 10, the pump P that conveys only in the direction to atomizer device 4 and the valve unit 22' connected in-between can be operated in any other manner.

The invention is also not limited to the described examples. In particular, the wound tube or coiled pipe serving as supply vessel can also be advantageously connected without the downline dosing pump for space saving. On the other hand, a dosing pump connected in the atomizer between the paint supply vessel and the atomization device can also be expedient for any other type of container.

In the atomizer used here, the usual high voltage cascade required for electrostatic coating can also be present.

The invention claimed is:

1. A method of delivering paint to a paint atomizer assembly using a robot comprising the steps of:

providing a dosing pump within a housing and being disposed between a paint tube and a paint atomizer forming an annular space between the housing and the dosing pump, the paint tube being a wound coil located in the annular space and including a scraper slidably disposed therein, said dosing pump being a direct drive mechanism controllable to convey in two opposite directions, the paint tube being coupled between the dosing pump and a source of a pressurized medium;

delivering paint to said assembly;

operating said dosing pump in a first direction thereby filling said paint tube and forcing said scraper rearwardly in said paint tube away from said atomizer;

pushing said scraper forwardly toward said atomizer with the pressurized medium thereby delivering paint to said dosing pump; and operating said dosing pump in an opposite direction thereby delivering paint to said paint atomizer.

2. The method set forth in claim 1, wherein said step of delivering paint to said assembly is further defined by delivering paint between said paint atomizer and said dosing pump.

3. The method as set forth in claim 1, further including the step of cleaning said dosing pump and said paint atomizer by providing a cleaning medium to said assembly between said dosing pump and said paint tube.

4. A method, as set forth in claim 1, wherein said dosing pump is a geared pump.

5. A method, as set forth in claim 1, wherein said dosing pump includes an electric motor.

6. A method of delivering paint to a paint atomizer assembly comprising the steps of:

providing a dosing pump disposed between a paint tube and a paint atomizer, wherein said paint tube includes a scraper slidably disposed therein and said dosing pump is operable in a first and second direction;

delivering paint to said assembly between said atomizer and said paint tube and operating said dosing pump backwards thereby filling said paint tube and forcing said scraper rearwardly in said paint tube away from said atomizer;

pushing said scraper toward said atomizer with a medium thereby delivering paint to said dosing pump;

operating said dosing pump in an opposite direction thereby delivering paint to said paint atomizer; and, cleaning said dosing pump and said paint atomizer by providing a cleaning medium to said assembly between said dosing pump and said paint tube, wherein said step of cleaning said dosing pump and said paint atomizer is further defined by sealing said paint tube from said cleaning medium with said scraper.

7. A method of delivering paint to a paint atomizer assembly comprising the steps of:

providing a dosing pump disposed between a paint tube and a paint atomizer, wherein said paint tube includes a scraper slidably disposed therein and said dosing pump is operable in a first and second direction;

delivering paint to said assembly between said atomizer and said paint tube and operating said dosing pump backwards thereby filling said paint tube and forcing said scraper rearwardly in said paint tube away from said atomizer;

pushing said scraper toward said atomizer with a medium thereby delivering paint to said dosing pump;

operating said dosing pump in an opposite direction thereby delivering paint to said paint atomizer; and, cleaning said dosing pump and said paint atomizer by providing a cleaning medium to said assembly between said dosing pump and said paint tube; and, providing first and second assemblies.

8. The method set forth in claim 7, further including the step of simultaneously cleaning and filling said first assembly with paint and applying paint with said second assembly.

9. An atomizer assembly mountable on a movable machine part, comprising:

a housing;

an atomizer disposed upon a distal end of said housing a dosing pump disposed within said housing, the dosing pump being a direct drive mechanism controllable to convey in two opposite directions, the housing and dosing pump forming an annular space being the housing and the dosing pump;

a paint tube disposed within the annular space between said housing and connected at one end to said dosing pump, the paint tube having a generally coiled configuration and having a scraper slidably disposed therein, wherein said paint tube presents a volume capable of retaining a predetermined dose of paint, said dosing pump being operable in a first direction to fill said paint tube with a predetermined dose of paint and thereby forcing said scraper rearwardly in said paint tube away from said atomizer; and, a source of pressurized medium coupled to another end of the paint tube for forcing said scraper forwardly in said paint tube toward said atomizer, thereby transferring the predetermined dose of paint from said paint tube to said dosing pump, said dosing pump being operable in a second direction, opposite said first direction, thereby delivering paint to said paint atomizer.

10. An assembly, as set forth in claim 9, wherein said dosing pump is a geared pump.

11. An assembly, as set forth in claim 9, wherein said dosing pump includes an electric motor.

12. An atomizer assembly mountable on a movable machine part, comprising:

a housing;

an atomizer disposed upon a distal end of said housing;

a dosing pump disposed within said housing;

a paint tube disposed within said housing in a generally coiled configuration defining an annular space and having a scraper slidably disposed therein, wherein said paint tube presents a volume capable of retaining a predetermined dose of paint, wherein said dosing pump is operable in opposite directions for filling said paint tube with a predetermined dose of paint and for transferring the predetermined dose of paint from said paint tube to said atomizer, said dosing pump being axially aligned relative to said annular space, wherein said scraper is slidable in opposite directions for receiving the predetermined dose of paint from said dosing pump and a second scraper direction for transferring the predetermined dose of paint back to said dosing pump; and a source of cleaning fluid fluidly connected to said assembly between said dosing pump and said paint line thereby providing cleaning to said assembly.

13. An atomizer assembly mountable on a movable machine part, comprising:

a housing;

an atomizer disposed upon a distal end of said housing;

a dosing pump disposed within said housing;

a paint tube disposed within said housing in a generally coiled configuration defining an annular space and having a scraper slidably disposed therein, wherein said paint tube presents a volume capable of retaining a predetermined dose of paint, wherein said dosing pump is operable in opposite directions for filling said paint tube with a predetermined dose of paint and for transferring the predetermined dose of paint from said paint tube to said atomizer, said dosing pump being axially aligned relative to said annular space; and a source of paint fluidly connected to said assembly between said atomizer and said dosing pump thereby providing paint to said dosing pump for filling said paint line with a predetermined dose of paint.

14. An assembly as set forth in claim 13, including a first valve disposed between said source of paint and said atomizer and being closeable for sealing said atomizer while providing paint to said dosing pump.

15. An atomizer assembly mountable on a movable machine part comprising:

a housing;

an atomizer disposed upon a distal end of said housing;

a dosing pump disposed within said housing;

a paint tube disposed within said housing in a generally coiled configuration defining an annular space and having a scraper slidably disposed therein, wherein said paint tube presents a volume capable of retaining a predetermined dose of paint, wherein said dosing pump is operable in opposite directions for filling said paint tube with a predetermined dose of paint and for transferring the predetermined dose of paint from said paint tube to said atomizer, said dosing pump being axially aligned relative to said annular space; and a paint fill and rinsing station interchangeably affixed to said housing thereby providing cleaning fluid and paint to said assembly.

16. An atomizer assembly mountable on a movable machine part, comprising:

a housing;

an atomizer disposed upon a distal end of said housing;

a dosing pump disposed within said housing; and, a paint tube disposed within said housing in a generally coiled configuration defining an annular space and having a scraper slidably disposed therein, wherein said paint tube presents a volume capable of retaining a predetermined dose of paint, wherein said dosing pump is operable in opposite directions for filling said paint tube with a predetermined dose of paint and for transferring the predetermined dose of paint from said paint tube to said atomizer, said dosing pump being axially aligned relative to said annular space, wherein said scraper is slidable in opposite directions for receiving the predetermined dose of paint from said dosing pump and a second scraper direction for transferring the predetermined dose of paint back to said dosing pump, wherein said paint line is coiled inside said housing thereby providing a length of said paint line capable of receiving the predetermined dose of paint.

17. An assembly as set forth in claim 16, wherein said paint line is coiled around said dosing pump.

* * * * *

UNITED STATES PATENT AND TRADEMARK OFFICE

CERTIFICATE OF CORRECTION

PATENT NO. : 7,051,950 B2
APPLICATION NO. : 11/158130
DATED : May 30, 2006
INVENTOR(S) : Stefano Giuliano It is certified that error appears in the above-identified patent and that said Letters Patent is hereby corrected as shown below:

In column 4, line 67, after the word "said," please insert the word --paint--.

In column 5, line 1, after the word "said," please insert the word --paint--.

In column 5, line 24, after the word "said," please insert the word --paint--.

In column 5, line 28, after the word "said," please insert the word --paint--.

In column 5, line 29, after the word "said," please insert the word --paint--.

In column 5, line 45, after the word "said," please insert the word --paint--.

In column 5, line 50, after the word "said," please insert the word --paint--.

In column 5, line 51, after the word "said," please insert the word --paint--.

In column 5, line 65, after the word "housing," please insert --;--.

In column 6, line 1, before the word "housing," please delete "the" and insert --said--

In column 6, line 2, before the word "dosing," please insert the word --said--.

In column 6, line 2, please delete "being" and insert --between--.

In column 6, lines 2 and 3, before the word "housing," please delete "the" and insert --said-- and before the word "dosing," please delete "the" and insert --said--.

In column 6, line 6, before the word "paint," please delete "the" and insert --said--.

In column 6, line 15, before the word "paint," please delete "the" and insert --said--.

In column 6, line 20, before the word "atomizer," please insert --paint--.

UNITED STATES PATENT AND TRADEMARK OFFICE

CERTIFICATE OF CORRECTION

PATENT NO. : 7,051,950 B2
APPLICATION NO. : 11/158130
DATED : May 30, 2006
INVENTOR(S) : Stefano Giuliano It is certified that error appears in the above-identified patent and that said Letters Patent is hereby corrected as shown below:

In column 6, line 41, please delete "in opposite directions" and insert --in a first scraper direction--.

In column 8, line 14, please delete "in opposite directions" and insert --in a first scraper direction--.

Signed and Sealed this

Thirtieth Day of January, 2007

JON W. DUDAS
*Director of the United States Patent and Trademark Office*